US011141726B2

(12) United States Patent
Lai et al.

(10) Patent No.: US 11,141,726 B2
(45) Date of Patent: Oct. 12, 2021

(54) CARTRIDGE AND METHOD OF DISTRIBUTING BIOLOGICAL SAMPLE IN FLUID CHANNEL THEREOF

(71) Applicant: LifeOS Genomics Corporation, Grand Cayman (KY)

(72) Inventors: Cheng-Chang Lai, Zhubei (TW); Hung-Wen Chang, Hsinchu (TW); Timothy Z. Liu, Fremont, CA (US); Ching-Jou Huang, Taichung (TW)

(73) Assignee: LifeOS Genomics Corporation, Grand Cayman (KY)

( * ) Notice: Subject to any disclaimer, the term of this patent is extended or adjusted under 35 U.S.C. 154(b) by 168 days.

(21) Appl. No.: 16/184,463

(22) Filed: Nov. 8, 2018

(65) Prior Publication Data

US 2019/0143322 A1 May 16, 2019

Related U.S. Application Data

(60) Provisional application No. 62/584,935, filed on Nov. 13, 2017, provisional application No. 62/634,936, filed on Feb. 26, 2018.

(51) Int. Cl.
*B01L 3/00* (2006.01)

(52) U.S. Cl.
CPC ... *B01L 3/502715* (2013.01); *B01L 3/502707* (2013.01); *B01L 2200/0673* (2013.01); *B01L 2200/0684* (2013.01); *B01L 2300/0887* (2013.01); *B01L 2300/12* (2013.01); *B01L 2400/0457* (2013.01)

(58) Field of Classification Search
CPC .. B01L 3/502715; B01L 3/5027; B01L 3/502; B01L 3/50; B01L 2200/0673; B01L 2200/06; B01L 2300/0887; B01L 2300/08
USPC ..... 422/502, 500, 501, 50
See application file for complete search history.

(56) References Cited

U.S. PATENT DOCUMENTS

| | | | | |
|---|---|---|---|---|
| 7,001,572 | B1 | 2/2006 | Gueritault et al. | |
| 8,974,748 | B2 * | 3/2015 | Bergman | B01L 3/502746 422/503 |
| 9,005,992 | B2 | 4/2015 | Cha et al. | |
| 9,012,562 | B2 | 4/2015 | Ciampini et al. | |
| 2002/0058329 | A1 * | 5/2002 | Singh | B82Y 30/00 435/287.2 |
| 2004/0018116 | A1 * | 1/2004 | Desmond | B01J 19/0093 422/502 |
| 2010/0112723 | A1 * | 5/2010 | Battrell | B01L 3/50273 436/501 |
| 2010/0297780 | A1 * | 11/2010 | De Theije | G01N 33/54366 436/526 |
| 2011/0008223 | A1 * | 1/2011 | Tsao | B01L 3/502715 422/502 |
| 2015/0263698 | A1 * | 9/2015 | Tanaka | G06F 16/954 310/313 C |
| 2016/0059201 | A1 | 3/2016 | Ueda et al. | |

* cited by examiner

*Primary Examiner* — Christine T Mui

(57) ABSTRACT

A cartridge includes a plate including a fluid inlet and a fluid outlet, a biochip disposed under the plate, and a first adhesive layer bonding the plate and the biochip. A fluid channel is formed between the plate and the biochip. The fluid inlet and the fluid outlet are in fluid communication with the fluid channel.

19 Claims, 10 Drawing Sheets

CARTRIDGE AND METHOD OF DISTRIBUTING BIOLOGICAL SAMPLE IN FLUID CHANNEL THEREOF

CROSS-REFERENCE TO RELATED APPLICATION

This application claims priority to U.S. Provisional Patent Application Ser. No. 62/584,935, filed Nov. 13, 2017 and U.S. Provisional Patent Application Ser. No. 62/634,936, filed Feb. 26, 2018, which are herein incorporated by reference in its entirety.

BACKGROUND

Technical Field

The present disclosure relates to a cartridge for analysis of biological sample and a method of distributing the biological sample in a fluid channel of the cartridge.

Description of Related Art

A cartridge made of different materials is designed for the analysis of biological samples in biomedical research and diagnostic applications. A biological or bio-chemical reaction is usually performed at an elevated temperature. Since coefficients of thermal expansion of the materials of the cartridge are different, a bonding strength therebetween becomes important. Bonding the materials of the cartridge has several ways including, for example, ultrasonic welding, thermal bonding or by screws, adhesive tape or glue.

SUMMARY

In some embodiments, a cartridge includes a plate including a fluid inlet and a fluid outlet, a biochip disposed under the plate, and a first adhesive layer bonding the plate and the biochip. A fluid channel is formed between the plate and the biochip. The fluid inlet and the fluid outlet are in fluid communication with the fluid channel.

In some embodiments, the cartridge further includes a second adhesive layer having a composition different from a composition of the first adhesive layer. The second adhesive layer is in contact with the first adhesive layer.

In some embodiments, a hardness of the second adhesive layer is greater than a hardness of the first adhesive layer.

In some embodiments, the fluid channel includes a front portion, a middle portion and a rear portion arranged in sequence from the fluid inlet to the fluid outlet. A height of the rear portion is greater than or equal to a height of the front portion. The height of the front portion is greater than or equal to a height of the middle portion.

In some embodiments, the fluid channel includes a front portion, a middle portion and a rear portion arranged in sequence from the fluid inlet to the fluid outlet. A height of the front portion is greater than or equal to a height of the rear portion. The height of the rear portion is greater than or equal to a height of the middle portion.

In some embodiments, the fluid channel includes a front portion, a middle portion and a rear portion arranged in sequence from the fluid inlet to the fluid outlet. A height of the front portion is greater than or equal to a height of the middle portion. The height of the middle portion is greater than or equal to a height of the rear portion.

In some embodiments, the fluid channel includes a front portion, a middle portion and a rear portion arranged in sequence from the fluid inlet to the fluid outlet. A height of the rear portion is less than a height of the front portion. The height of the front portion is less than a height of the middle portion.

In some embodiments, the fluid channel includes a front portion, a middle portion and a rear portion arranged in sequence from the fluid inlet to the fluid outlet. A height of the front portion is less than a height of the rear portion. The height of the rear portion is less than a height of the middle portion.

In some embodiments, the fluid channel includes a front portion, a middle portion and a rear portion arranged in sequence from the fluid inlet to the fluid outlet. A height of the front portion is less than a height of the middle portion. The height of the middle portion is less than a height of the rear portion.

In some embodiments, a method of distributing a biological sample in a fluid channel of a cartridge includes bonding a plate including a fluid inlet and a fluid outlet to a biochip to form a cartridge using a first adhesive layer; injecting a biological sample through the fluid inlet to flow into the fluid channel in a direction; and injecting a liquid having a material immiscible with a material of the biological sample through the fluid inlet to push the biological sample along the direction. A fluid channel is formed between the biochip and the plate. The fluid channel includes a front portion, a middle portion and a rear portion arranged in sequence from the fluid inlet to the fluid outlet.

In some embodiments, the method further includes bonding the plate and the biochip using a second adhesive layer after the bonding the plate to the biochip using the first adhesive layer. A hardness of the first adhesive layer is less than a hardness of the second adhesive layer.

In some embodiments, the method further includes heating the biochip before injecting the biological sample.

In some embodiments, the method further includes heating the biochip after injecting the biological sample such that air bubbles in a well of the biochip has sufficient buoyant force to escape from the well.

In some embodiments, the method further includes tilting the cartridge with an angle with respect to a vertical direction defined by gravity prior to injecting the biological sample. The angle is in a range from about 0° to about 90°.

In some embodiments, a flow velocity of the biological sample in the rear portion is less than or equal to a flow velocity of the biological sample in the front portion, and the flow velocity of the biological sample in the front portion is less than or equal to a flow velocity of the biological sample in the middle portion.

In some embodiments, a flow velocity of the biological sample in the front portion is less than or equal to a flow velocity of the biological sample in the rear portion, and the flow velocity of the biological sample in the rear portion is less than or equal to a flow velocity of the biological sample in the middle portion.

In some embodiments, a flow velocity of the biological sample in the front portion is less than or equal to a flow velocity of the biological sample in the middle portion, and the flow velocity of the biological sample in the middle portion is less than or equal to a flow velocity of the biological sample in the rear portion.

In some embodiments, a flow velocity of the biological sample in the rear portion is greater than a flow velocity of the biological sample in the front portion, and the flow velocity of the biological sample in the front portion is greater than a flow velocity of the biological sample in the middle portion.

In some embodiments, a flow velocity of the biological sample in the front portion is greater than a flow velocity of the biological sample in the rear portion, and the flow velocity of the biological sample in the rear portion is greater than a flow velocity of the biological sample in the middle portion.

In some embodiments, a flow velocity of the biological sample in the front portion is greater than a flow velocity of the biological sample in the middle portion, and the flow velocity of the biological sample in the middle portion is greater than a flow velocity of the biological sample in the rear portion.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiments, with reference made to the accompanying drawings as follows.

DETAILED DESCRIPTION

Figure 1:
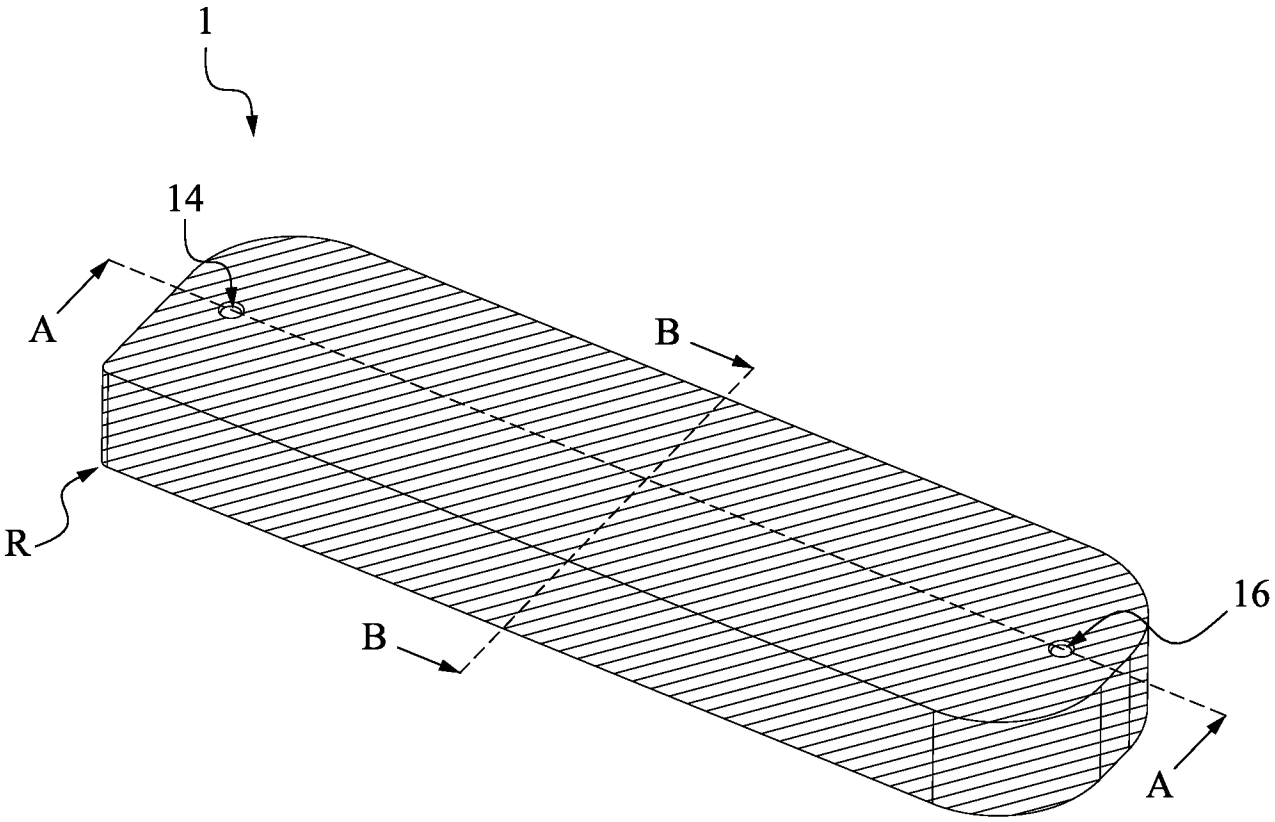
FIG. 1 is a perspective view of a cartridge in accordance with some embodiments.

Reference will now be made in detail to the present embodiments of the disclosure, examples of which are illustrated in the accompanying drawings. Wherever possible, the same reference numbers are used in the drawings and the description to refer to the same or like parts.

Figure 2:
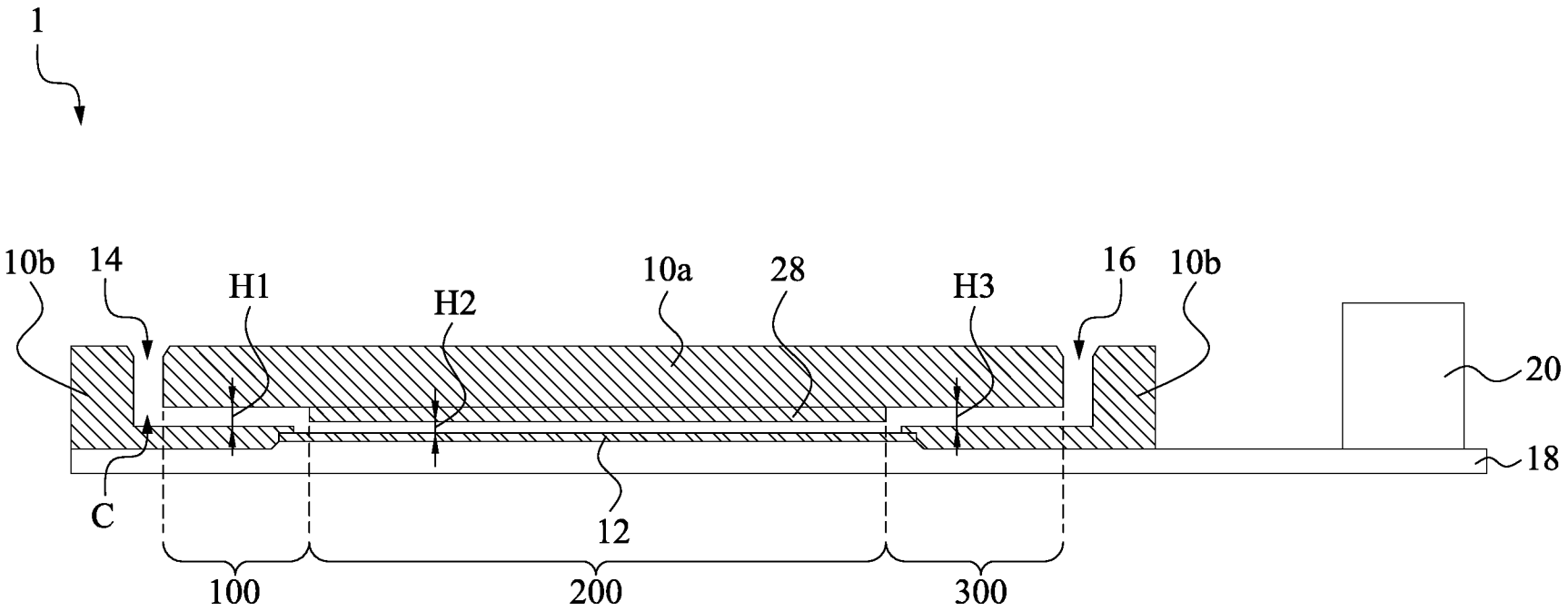
FIG. 2 is a cross-sectional view of the cartridge in FIG. 2, along the "A-A" line of FIG. 1, and placed on a thermal conducting plate that is attached to an electric thermal heating and cooling device in accordance with some embodiments.
Figure 3:
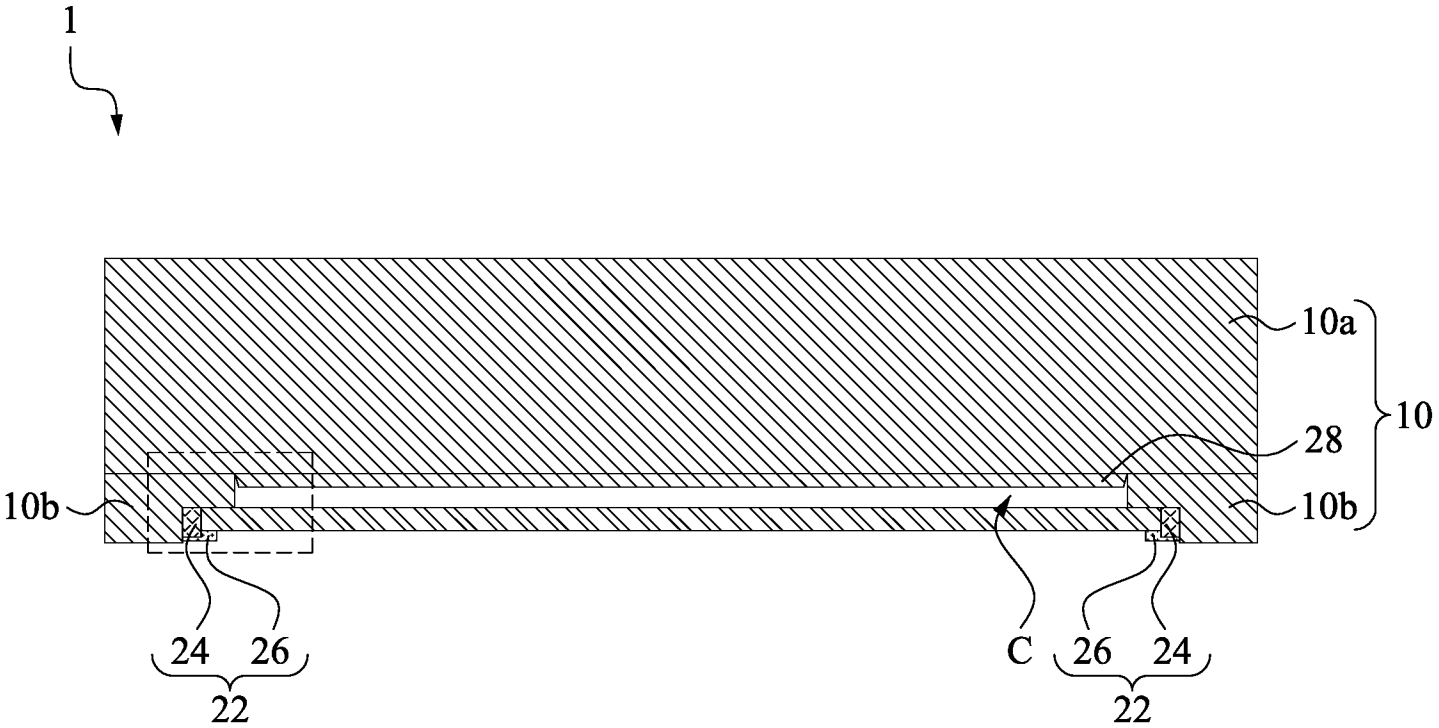
FIG. 3 is a cross-sectional view of the cartridge in FIG. 2, along the "B-B" line of FIG. 1, in accordance with some embodiments.

FIGS. 1-3 show a cartridge 1 in accordance with some embodiments of the present disclosure. Reference is made to FIGS. 1-3. As will become apparent, the cartridge 1 is designed for the analysis of biological samples in biochemical research and diagnostic applications. The cartridge 1 includes a plate 10 and a biochip 12 disposed under the plate 10. The plate 10 has a top portion 10*a* and fence portions 10*b* connected to the top portion 10*a*. The fence portion 10*b* is under the top portion 10*a* and surrounds the biochip 12. An alignment region R is disposed on an edge portion of the cartridge 1. A fluid channel C is formed between the plate 10 and the biochip 12. The plate 10 includes a fluid inlet 14 and a fluid outlet 16. The fluid inlet 14 and the fluid outlet 16 are in fluid communication with the fluid channel C. The fluid inlet 14 and the fluid outlet 16 allow the loading and unloading of flowable biological samples, such as genetic materials during Polymerase Chain Reaction (PCR), in the fluid channel C. Either the fluid inlet 14 or the fluid outlet 16 is to allow air or excess sample to exit the fluid channel C. The cartridge 1 is placed on a thermal conducting plate 18 that is thermally coupled to an electric thermal heating and cooling device 20. In some embodiments, the materials of the plate 10 and the biochip 12 can include glass, silicon, polymeric material and other materials known in the art that are compatible with biochemical reaction and fluorescence detection.

In some embodiments, the flow velocity of the biological sample can be controlled by the height of the fluid channel C when the cross-sectional area of the fluid channel C is fixed. The fluid channel C includes a front portion 100, a middle portion 200 and a rear portion 300 arranged in sequence from the fluid inlet 14 to the fluid outlet 16. For example, the front portion 100 of the fluid channel C has a height H1, the middle portion 200 of the fluid channel C has a height H2, and the rear portion 300 of the fluid channel C has a height H3. The front portion 100 is closer to the fluid inlet 14 than the middle portion 200 is. The rear portion 300 is closer to the fluid outlet 16 than the middle portion 200 is. The middle portion 200 is between the front portion 100 and the rear portion 300. The heights of H1, H2 and H3 can be controlled by a bonding process of the plate 10 and the biochip 12, for example, by the pressure applied to the plate 10 and the biochip 12 during the ultrasonic welding process.

In some embodiments, the height H3 of the rear portion 300 is greater than or equal to the height H1 of the front portion 100, so that a flow velocity of the fluid in the rear portion 300 is less than or equal to a flow velocity of the fluid in the front portion 100. The height H1 of the front portion 100 is greater than or equal to the height H2 of the middle portion 200, so that the flow velocity of the fluid in the front portion 100 is less than or equal to a flow velocity of the fluid in the middle portion 200.

In some embodiments, the height H1 of the front portion 100 is greater than or equal to the height H3 of the rear portion 300, so that a flow velocity of the fluid in the front portion 100 is less than or equal to a flow velocity of the fluid in the rear portion 300. The height H3 of the rear portion 300 is greater than or equal to the height H2 of the middle portion 200, so that the flow velocity of the fluid in the rear portion 300 is less than or equal to a flow velocity of the fluid in the middle portion 200.

In some embodiments, the height H1 of the front portion 100 is greater than or equal to the height H2 of the middle portion 200, so that a flow velocity of the fluid in the front portion 100 is less than or equal to a flow velocity of the fluid in the middle portion 200. The height H2 of the middle portion 200 is greater than or equal to the height H3 of the rear portion 300, so that the flow velocity of the fluid in the middle portion 200 is less than or equal to a flow velocity of the fluid in the rear portion 300.

In some embodiments, the height H3 of the rear portion 300 is less than the height H1 of the front portion 100, so that a flow velocity of the fluid in the rear portion 300 is greater than a flow velocity of the fluid in the front portion 100. The height H1 of the front portion 100 is less than the height H2 of the middle portion 200, so that the flow velocity of the fluid in the front portion 100 is greater than a flow velocity of the fluid in the middle portion 200.

In some embodiments, the height H1 of the front portion 100 is less than the height H3 of the rear portion 300, so that a flow velocity of the fluid in the front portion 100 is greater than a flow velocity of the fluid in the rear portion 300. The height H3 of the rear portion 300 is less than the height H2 of the middle portion 200, so that the flow velocity of the fluid in the rear portion 300 is greater than a flow velocity of the fluid in the middle portion 200.

In some embodiments, the height H1 of the front portion 100 is less than the height H2 of the middle portion 200, so that a flow velocity of the fluid in the front portion 100 is greater than a flow velocity of the fluid in the middle portion 200. The height H2 of the middle portion 200 is less than the height H3 of the rear portion 300, so that the flow velocity of the fluid in the middle portion 200 is greater than a flow velocity of the fluid in the rear portion 300.

PCR has proven a phenomenally successful technology for genetic analysis, because it is so simple and requires relatively low cost instrumentation. PCR involves the concept of thermal cycling: alternating steps of melting DNA, annealing short primers to the resulting single strands, and extending those primers to make new copies of double stranded DNA. In thermal cycling, the PCR reaction mixture is repeatedly cycled from high temperatures (>90° C.) for melting the DNA, to lower temperatures (40° C. to 70° C.) for primer annealing and extension.

In some embodiments, the plate 10 and the biochip 12 may include different materials, for example, the plate 10 includes polymeric material and the biochip 12 includes silicon. The interface between the plate 10 and the biochip 12 are thus subject to thermal stresses that occur during PCR periods in which the cartridge 1 is heated or cooled. The thermal stresses, and consequent thermally induced strains, at the interface between the plate 10 and the biochip 12 arise from a mismatch in coefficient of thermal expansion (CTE) between the plate 10 and the biochip 12.

Figure 4A:
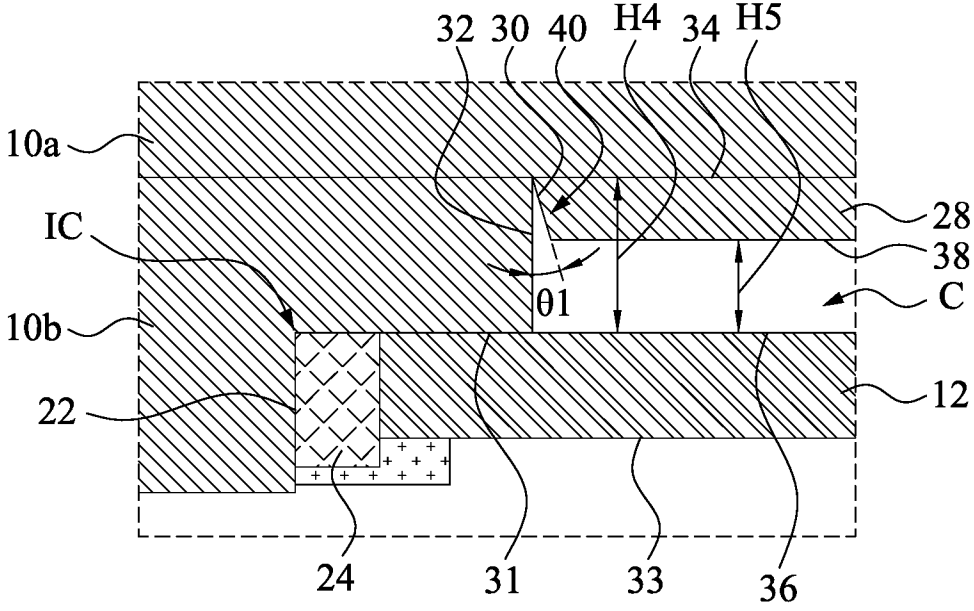
FIG. 4A shows an enlarged partial cross-sectional view of the cartridge of FIG. 3 in accordance with some embodiments.

FIG. 4A shows an enlarged partial cross-sectional view of the cartridge of FIG. 3. The fence portion 10*b* has a first inner sidewall 32, a second inner sidewall 22 substantially parallel to the first inner sidewall, and an intermediary surface 31 connecting the first inner sidewall 32 to the second inner sidewall 22 and substantially perpendicular to the inner sidewalls 32 and 22. The second inner sidewall 22 and the intermediary surface 31 define an internal corner IC. The biochip 12 is partially in contact with the intermediary surface 31 of the fence portion 10*b*. A first adhesive layer 24 may be positioned between the plate 10 and the biochip 12 in order to bond the biochip 12 to the plate 10. In some embodiments, the first adhesive layer 24 surrounds the biochip 12. In particular, the first adhesive layer 24 is in contact with the intermediary surface 31 and the second inner sidewall 22 of the fence portion 10*b*. The first adhesive layer 24 has a first composition and a first chemical property such as flow velocity, wetability, strength, gap filling, material compatibility, temperature versus viscosity, ease of application, or another suitable chemical property. In particular, the first adhesive layer 24 functions as a damping material and reduces or compensates for the stress generated by mismatch in coefficient of thermal expansions of the plate 10 and the biochip 12 during PCR.

In particular, a second adhesive layer 26 is positioned between the plate 10 and the biochip 12 and bonds the biochip 12 to the plate 10. In particular, the second adhesive layer 26 is in contact with the second inner sidewall 22 of the fence portion 10*b* and a bottom surface 33 of the biochip 12. The second adhesive layer 26 is in contact with the first adhesive layer 24. The second adhesive layer 26 is configured to protect the first adhesive layer 24 and enhance the bonding strength between the plate 10 and the biochip 12. The second adhesive layer 26 has a second chemical property, such as flow velocity, wetability, strength, gap filling, material compatibility, temperature versus viscosity, ease of application, or another suitable adhesive or chemical property. The second chemical property is different from the first chemical property. For example, the hardness of the second adhesive layer 26 is greater than the hardness of the first adhesive layer 24. In some embodiments, the hardness of the first adhesive layer 24 is less than 60 Shore D. In some embodiments, the hardness of the second adhesive layer 26 is greater than 60 Shore D. In some embodiments, the first and second adhesive layers 24 and 26 include silicone glue, thermal-plastic glue, thermal-set glue, photo-chemical glue, epoxy resin, or a combination thereof. The hardnesses of the first and second adhesive layers 24 and 26 can be adjusted by different compositions of the glues.

In some embodiments, the formations of the first and second adhesive layers 24 and 26 are performed in a range from about 4° C. to about 110° C. The first and second adhesive layers 24 and 26 have a glass transition temperature (Tg) of greater than about 90° C., and a visible light transmittance of at least 80% in the wavelength range from about 400 nm to 700 nm. Furthermore, the first and second adhesive layers 24 and 26 have a self-fluorescence intensity lower than 3000 a.u.

The cartridge 1 may have various types of fluid control mechanism for the purpose of controlling a continuous and uniform flow of a fluid, for example, the biological sample. Still referring to FIG. 4A, the plate 10 has a protrusion 28 protruding from a bottom surface 34 of the top portion 10*a* of the plate 10 and toward the biochip 12. The protrusion 28 is configured to control the fluid flow of the biological sample in the fluid channel C by capillary force. In particular, a first sidewall 30 of the protrusion 28 and the first inner sidewall 32 of the fence portion 10*b* define a first angle θ1 ranging from about 0° to about 90°. In some embodiments where the angle θ1 is an acute angle, such as less than about 90°, a height H4 between the bottom surface 34 of the top portion 10*a* of the plate 10 and a top surface 36 of the biochip 12 is greater than a height H5 between a bottom surface 38 of the protrusion 28 and the top surface 36 of the biochip 12. Therefore, the first sidewall 30 of the protrusion 28 defines a gap 40 with the first inner sidewall 32 of the fence portion 10*b*. A capillary force of the fluid flow can be adjusted by the gap 40 and thus makes the fluid near the edge of the fluid channel C flow faster than the fluid near the center of the fluid channel C, and results in alleviating air bubble trapping phenomena. The angle θ1 can be equal to or greater than 90° in other embodiments. In some embodiments where the angle θ1 is equal to about 90°, the height H4 is equal to the height H5. In some embodiments where the angle θ1 is greater than 90°, the height H4 is less than the height H5. In some embodiments where the angle θ1 is equal to about zero degree, the first sidewall 30 of the protrusion 28 is in contact with the first inner sidewall 32 of the fence portion 10*b* of the plate 10.

Figure 4B:
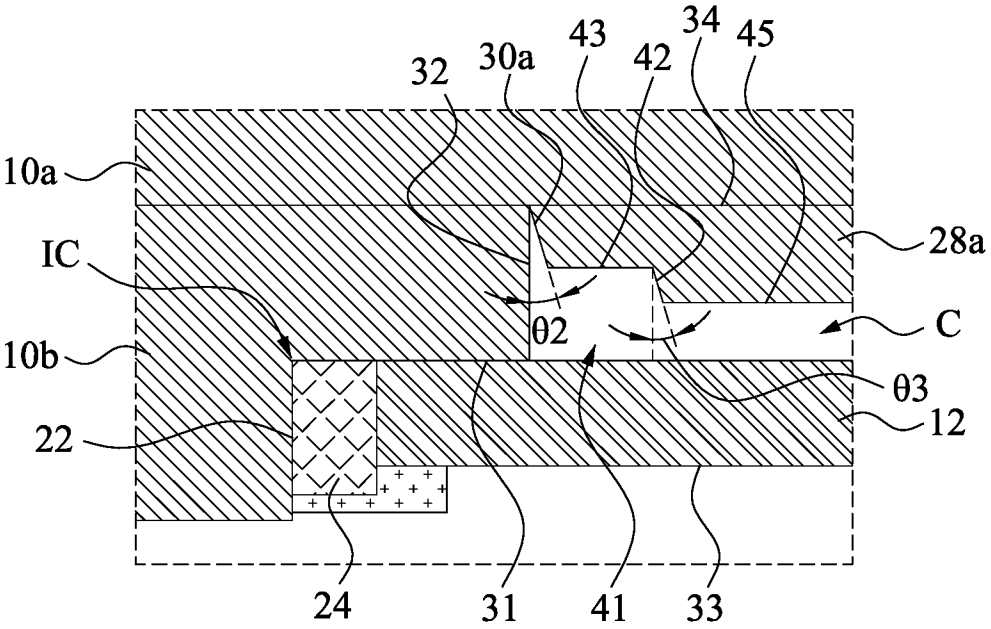
FIG. 4B shows an enlarged partial cross-sectional view of the cartridge of FIG. 3 in accordance with some embodiments.

Referring to FIG. 4B, the difference between the protrusion 28*a* and the protrusion 28 in FIG. 4A is that the protrusion 28*a* is a stepped structure including a first sidewall 30*a*, a first horizontal surface 43, a second sidewall 42, and a second horizontal surface 45 connected in sequence. The first sidewall 30*a* of the protrusion 28*a* and the first inner sidewall 32 of the fence portion 10*b* define an angle θ2 ranging from about 0° to about 90°. The second sidewall 42 has an angle θ3. In some embodiments, the angle θ2 is from about 0° to about 90°, and the angle θ3 is from about 0° to about 90°. In some embodiments where the angle θ2 and the angle θ3 are acute angles, such as less than 90°, the first sidewall 30*a*, the first horizontal surface 43 and the second sidewall 42 define a gap 41 with the first inner sidewall 32 of the fence portion 10*b*. A capillary force of the fluid flow can be adjusted by the gap 41 and thus makes the fluid near the edge of the fluid channel C flow faster than the fluid near the center of the fluid channel C, and results in alleviating air bubble trapping phenomena. In other embodiments, the angle θ2 can be equal to or greater than 90°, and the angle θ3 can be equal to or greater than 90°. In some embodiments where the angle θ2 is equal to about zero degree, the first sidewall 30*a* of the protrusion 28*a* is in contact with the first inner sidewall 32 of the fence portion 10*b* of the plate 10.

Figure 5A:
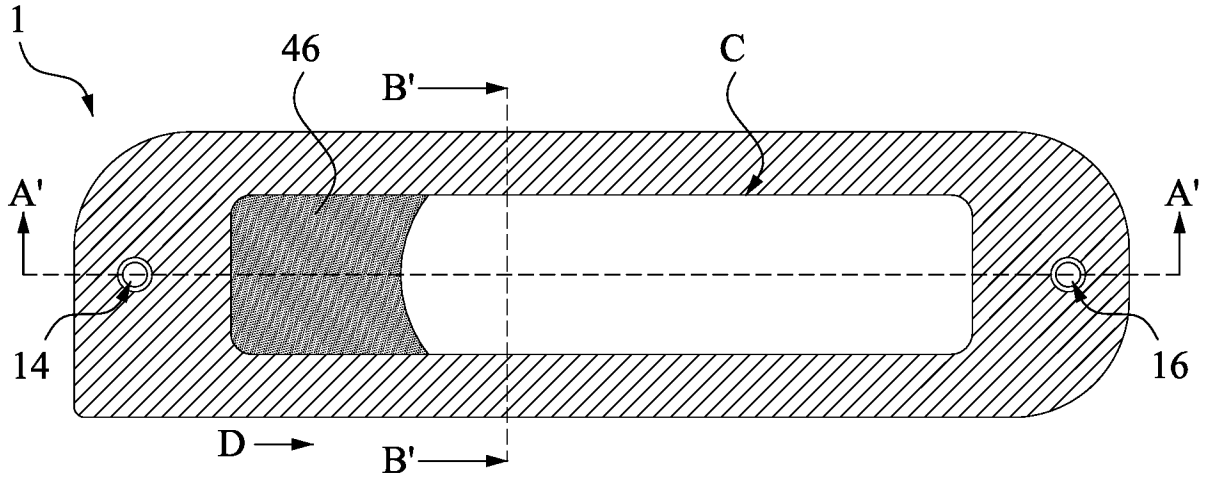
FIGS. 5A and 6A show a fluid flow in the cartridge in accordance with some embodiments.
Figure 5B:
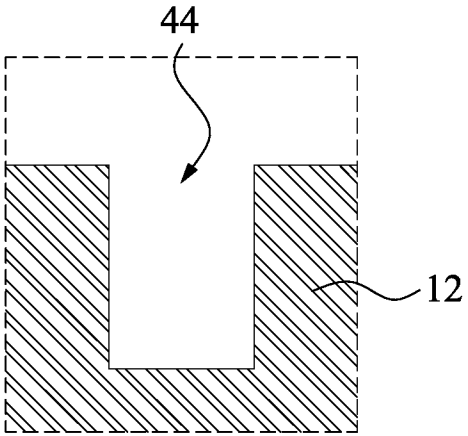
FIGS. 5B and 6B show cross-sectional views of a well in the biochip, along the "B'-B'" line of FIGS. 5A and 6A, respectively.
Figure 5C:
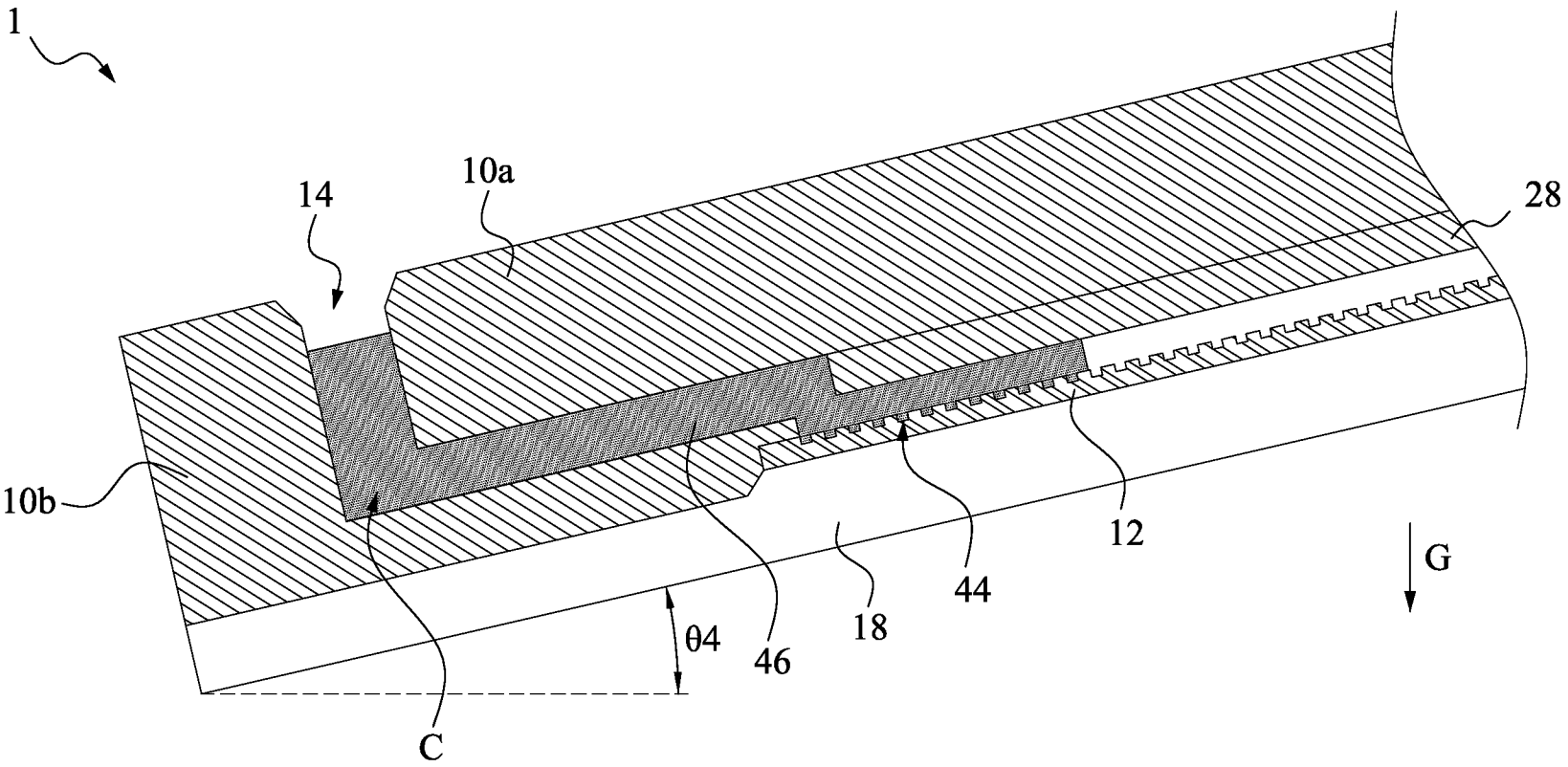
FIGS. 5C and 6C show enlarged partial cross-sectional views of the cartridge, along the "A'-A'" line of FIGS. 5A and 6A, respectively.
Figure 6A:
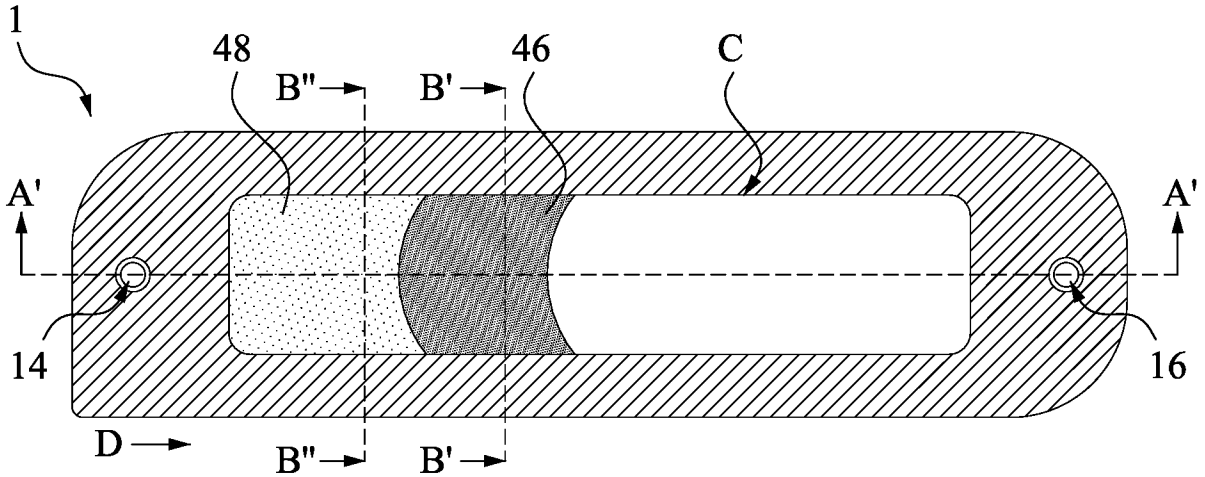
Figure 6B:
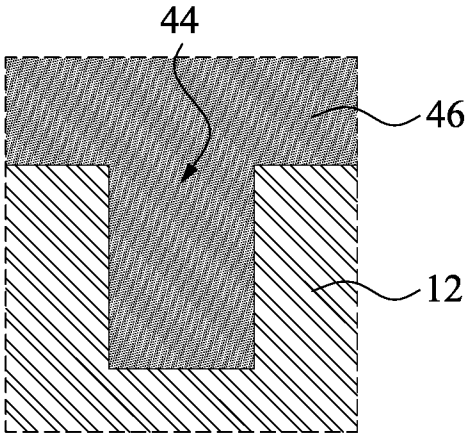
Figure 6C:
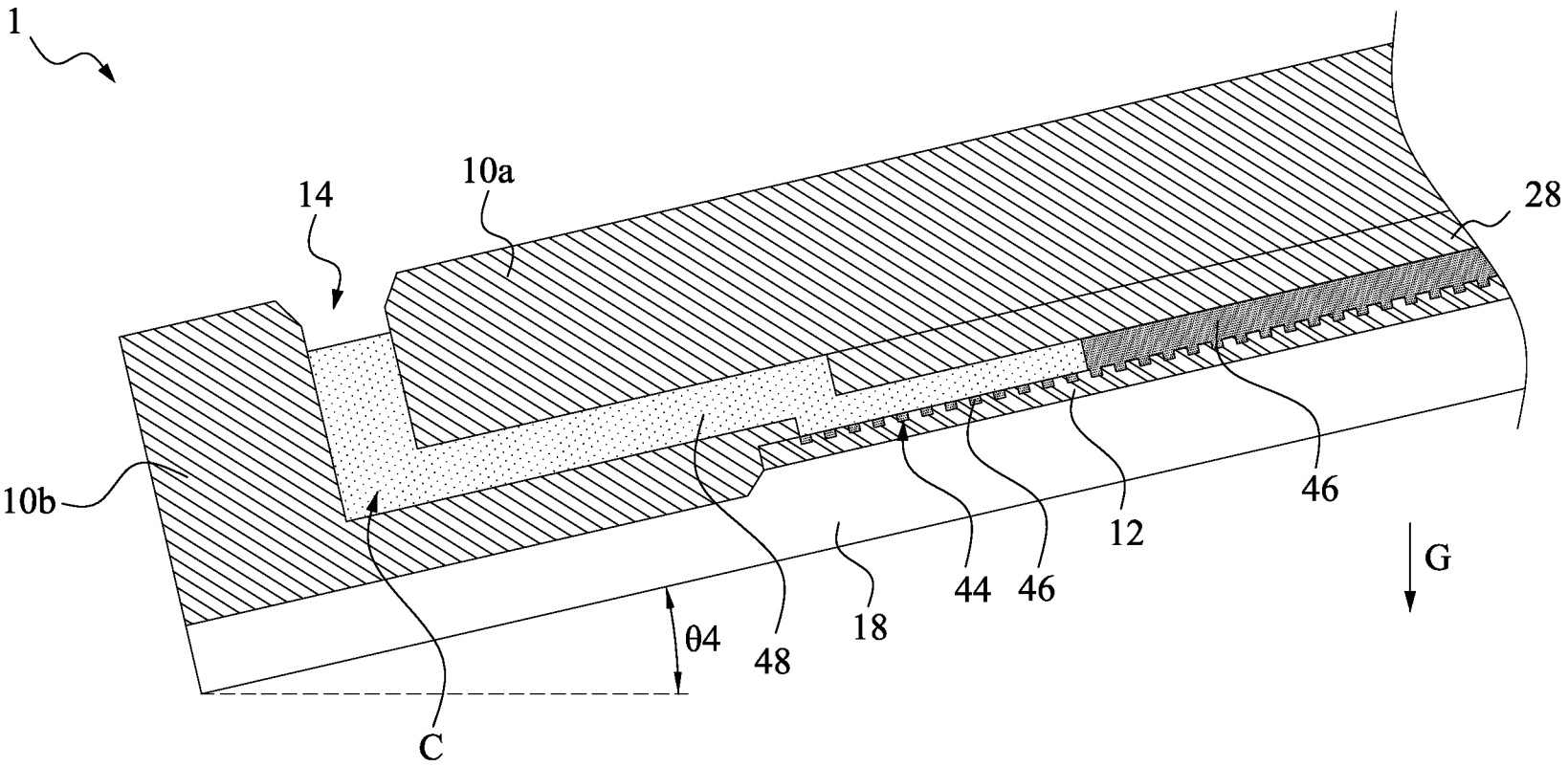
Figure 6D:
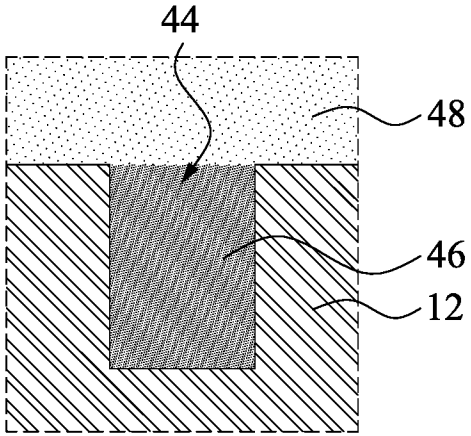
FIG. 6D show cross-sectional views of a well in the biochip, along the "B"-B"" line of FIG. 6A.

A filling process can be adapted in biological sample distribution before PCR. FIGS. 5A and 6A show a fluid flow in the cartridge 1 in accordance with some embodiments. FIGS. 5B, 6B, and 6D show cross-sectional views of a well 44 in the biochip 12 corresponding to FIGS. 5A and 6A. FIGS. 5C and 6C show enlarged partial cross-sectional views of the cartridge, along the "A'-A'" line of FIGS. 5A and 6A, respectively.

The biochip 12 is configured to execute bio-chemistry reaction, for example, PCR. In particular, the biochip 12 functions as a carrier and includes a plurality of wells 44 to be filled by the biological sample (e.g., the first liquid 46). Reference is made to FIGS. 5A, 5B, and 5C. The first liquid 46 is injected through the fluid inlet 14 to flow into the fluid channel C in a direction D. In some embodiments, the cartridge 1 is tilted with an angle θ4 with respect to a vertical direction G by gravity prior to injecting the biological sample (e.g., the first liquid 46), so that the fluid outlet 16 is at an elevation higher than the fluid inlet 14. In some embodiments, the angle θ4 is in a range from about 0° to about 90°. The tilting is performed such that a capillary force of the fluid flow of the first liquid 46 can be adjusted by the gravity and thus makes the first liquid 46 near the edge of the fluid channel C flow faster than the first liquid 46 near the center of the fluid channel C, and in turn increases a uniformity and a stability of the fluid flow of the first liquid 46 in the fluid channel C. In some other embodiments, the cartridge 1 may not be tilted with an angle during the PCR.

In some embodiments, the first liquid 46 has high surface tension and low specific weight such that it is difficult for the first liquid 46 to fill the wells 44 in the biochip 12 uniformly since surface tension is the dominate force to control microscale fluid flow. Reference is made to FIGS. 6A and 6C. A second liquid 48 immiscible with the first liquid 46 is injected through the fluid inlet 14 after the injection of the first liquid 46 to push the first liquid 46 toward the direction D. In some embodiments, the second liquid 48 has low surface tension, high specific weight, high boiling point and high thermal conductivity such that the second liquid 48 can increase the uniformity of the distribution of the first liquid 46 in the wells 44 in the biochip 12. In some embodiments, the specific weight of the second liquid 48 is higher than the specific weight of the first liquid 46 such that the second liquid 48 remains closer to the fluid inlet 14 than the first liquid 46 is. Therefore, the usage of the volume of the first liquid 46, which may be expensive, can be reduced by using such filling process. In some other embodiments, depending on applications for various biological or bio-chemical reactions analysis, the specific weight of the first liquid 46 can be greater than or equal to the specific weight of the second liquid 48. In particular, the surface tension and the boiling point of the first liquid 46 can be either greater than, equal to or less than the second liquid 48 depending on the applications for various biological or bio-chemical reactions analysis.

Reference is made to FIGS. 6B and 6D. The wells 44 are filled with the first liquid 46. After injecting the second liquid 48, the second liquid 48 covers top surfaces of a portion of the first liquid 46 in the wells 44, as shown in FIG. 6D. In some embodiments, because the second liquid 48 has higher boiling point than the temperature performed during the PCR, the second liquid 48 can prevent the first liquid 46 from evaporation during the PCR.

In some embodiments, the biochip 12 is heated via the thermal conducting plate 18 that is attached to an electric thermal heating and cooling device 20 (see FIG. 2) after the fluid flow of the first liquid 46 such that air bubbles produced in the wells 44 during the fluid flow of the first liquid 46 are also heated. Air bubbles with sufficient buoyant force rise to a top of the well and exit the well through the fluid inlet 14 or the fluid outlet 16. When the buoyant force of the air bubble is greater than the surface tension of the first liquid 46, the air bubbles will be removed from the wells 44 and the first liquid 46 will automatically be delivered into the wells 44. In some embodiments, the biochip 12 is heated before the loading of the first liquid 46 such that the first liquid 46 can also be heated via heat conduction from the biochip 12. The surface tension of the first liquid 46 with increased temperature is reduced such that the first liquid 46 can easily flow into the wells 44 of the biochip 12.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A cartridge, comprising:

a plate including a fluid inlet and a fluid outlet, wherein the plate comprises a top portion and a fence portion placed underneath and connected to the top portion, and the fluid inlet and the fluid outlet are spaced apart in a first direction; and a biochip disposed under the plate, wherein a fluid channel is formed between the plate and the biochip and has a boundary consisting of sidewalls of the plate and a top surface of the biochip, the fluid inlet is in fluid communication through the fluid channel with the fluid outlet, the top portion has only one protrusion disposed in a lengthwise direction of the top portion, the only one protrusion protrudes toward the biochip, and a first sidewall of the protrusion meets a second sidewall of the fence portion to define a first acute angle therebetween and form a first gap, a third sidewall of the protrusion being opposite to the first sidewall of the protrusion meets a fourth sidewall of the fence portion to define a second acute angle therebetween and form a second gap, the first gap and the second gap are spaced apart in a second direction crossing the first direction.

2. The cartridge of claim 1, further comprising:

a first adhesive layer bonding the plate and the biochip; and a second adhesive layer having a composition different from a composition of the first adhesive layer, wherein the second adhesive layer is in contact with the first adhesive layer.

3. The cartridge of claim 2, wherein a hardness of the second adhesive layer is greater than a hardness of the first adhesive layer.

4. The cartridge of claim 1, wherein the fluid channel includes a front portion, a middle portion and a rear portion arranged in sequence from the fluid inlet to the fluid outlet, a height of the rear portion is greater than or equal to a height of the front portion, the height of the front portion is greater than or equal to a height of a center of the middle portion.

5. The cartridge of claim 1, wherein the fluid channel includes a front portion, a middle portion and a rear portion arranged in sequence from the fluid inlet to the fluid outlet, a height of the front portion is greater than or equal to a height of the rear portion, the height of the rear portion is greater than or equal to a height of a center of the middle portion.

6. The cartridge of claim 1, wherein the fluid channel includes a front portion, a middle portion and a rear portion arranged in sequence from the fluid inlet to the fluid outlet, a height of the front portion is greater than or equal to a height of a center of the middle portion, the height of the center of the middle portion is greater than or equal to a height of the rear portion.

7. The cartridge of claim 1, wherein the fluid channel includes a front portion, a middle portion and a rear portion arranged in sequence from the fluid inlet to the fluid outlet, a height of the rear portion is less than a height of the front portion, the height of the front portion is less than a height of a center of the middle portion.

8. The cartridge of claim 1, wherein the fluid channel includes a front portion, a middle portion and a rear portion arranged in sequence from the fluid inlet to the fluid outlet, a height of the front portion is less than a height of the rear portion, the height of the rear portion is less than a height of a center of the middle portion.

9. The cartridge of claim 1, wherein the fluid channel includes a front portion, a middle portion and a rear portion arranged in sequence from the fluid inlet to the fluid outlet, a height of the front portion is less than a height of a center of the middle portion, the height of the center of the middle portion is less than a height of the rear portion.

10. A method of distributing a biological sample in a fluid channel of a cartridge, comprising:

bonding a plate including a fluid inlet and a fluid outlet to a biochip to form a cartridge, wherein a fluid channel is formed between the biochip and the plate and has a boundary consisting of sidewalls of the plate and a top surface of the biochip, the fluid inlet and the fluid outlet are spaced apart in a first direction, the plate includes a top portion and a fence portion under and connected to the top portion, the top portion comprises only one protrusion protruding toward the biochip in a lengthwise direction of the top portion, a first sidewall of the protrusion meets a second sidewall of the fence portion to define a first acute angle therebetween and form a first gap, a third sidewall of the protrusion being opposite to the first sidewall of the protrusion meets a fourth sidewall of the fence portion to define a second acute angle therebetween and form a second gap, the first gap and the second gap are spaced apart in a second direction crossing the first direction, and the fluid channel includes a front portion, a middle portion and a rear portion arranged in sequence from the fluid inlet to the fluid outlet;

injecting a biological sample through the fluid inlet to flow into the fluid channel in a direction, wherein a fluid flow of the biological sample is affected by the acute angle defined by the first and third sidewalls of the protrusion and the second and fourth sidewalls of the fence portion such that a portion of the biological sample near an edge of the fluid channel flows at a flow rate different from a flow rate of a portion of the biological sample near a center of the fluid channel; and injecting a liquid comprising a material immiscible with the biological sample through the fluid inlet to push the biological sample along the direction in the fluid channel.

11. The method of claim 10, further comprising:

heating the biochip before injecting the biological sample.

12. The method of claim 10, further comprising:

heating the biochip comprising a plurality of wells after injecting the biological sample such that air bubbles in the wells of the biochip have sufficient buoyant force to escape from the wells.

13. The method of claim 10, further comprising:

tilting the cartridge with a second angle with respect to a vertical direction defined by gravity prior to injecting the biological sample, wherein the second angle is in a range from about 0° to about 90°.

14. The method of claim 10, wherein after bonding the plate to the biochip, a height of the rear portion is greater than or equal to a height of the front portion and the height of the front portion is greater than or equal to a height of a center of the middle portion such that a flow velocity of the biological sample in the rear portion is less than or equal to a flow velocity of the biological sample in the front portion, and the flow velocity of the biological sample in the front portion is less than or equal to a flow velocity of the biological sample in the middle portion.

15. The method of claim 10, wherein after bonding the plate to the biochip, a height of the front portion is greater than or equal to a height of the rear portion and the height of the rear portion is greater than or equal to a height of a center of the middle portion such that a flow velocity of the biological sample in the front portion is less than or equal to a flow velocity of the biological sample in the rear portion, and the flow velocity of the biological sample in the rear portion is less than or equal to a flow velocity of the biological sample in the middle portion.

16. The method of claim 10, wherein after bonding the plate to the biochip, a height of the front portion is greater than or equal to a height of a center of the middle portion and the height of the center of the middle portion is greater than or equal to a height of the rear portion such that a flow velocity of the biological sample in the front portion is less than or equal to a flow velocity of the biological sample in the middle portion, and the flow velocity of the biological sample in the middle portion is less than or equal to a flow velocity of the biological sample in the rear portion.

17. The method of claim 10, wherein after bonding the plate to the biochip, a height of the rear portion is less than a height of the front portion and the height of the front portion is less than a height of a center of the middle portion such that a flow velocity of the biological sample in the rear portion is greater than a flow velocity of the biological sample in the front portion, and the flow velocity of the biological sample in the front portion is greater than a flow velocity of the biological sample in the middle portion.

18. The method of claim 10, wherein after bonding the plate to the biochip, a height of the front portion is less than a height of the rear portion and the height of the rear portion is less than a height of a center of the middle portion such that a flow velocity of the biological sample in the front portion is greater than a flow velocity of the biological sample in the rear portion, and the flow velocity of the biological sample in the rear portion is greater than a flow velocity of the biological sample in the middle portion.

19. The method of claim 10, wherein after bonding the plate to the biochip, a height of the front portion is less than a height of a center of the middle portion and the height of the center of the middle portion is less than a height of the rear portion such that a flow velocity of the biological sample in the front portion is greater than a flow velocity of the biological sample in the middle portion, and the flow velocity of the biological sample in the middle portion is greater than a flow velocity of the biological sample in the rear portion.

* * * * *